United States Patent [19]

Sano et al.

[11] Patent Number: 4,716,079

[45] Date of Patent: Dec. 29, 1987

[54] EXCELLENT WINDABILITY MAGNET WIRE

[75] Inventors: Fumikazu Sano, Hiratsuka; Masakazu Mezaki, Yokohama, both of Japan

[73] Assignee: The Furukawa Electric Co. Ltd., Tokyo, Japan

[21] Appl. No.: 16,873

[22] Filed: Feb. 20, 1987

[30] Foreign Application Priority Data

Feb. 27, 1986 [JP] Japan ..... 61-40429

[51] Int. Cl.[4] ..... B32B 27/00; D02G 3/00

[52] U.S. Cl. ..... 428/383; 428/375; 428/378; 174/110 FC; 174/110 SR; 174/120 C; 174/120 SR; 524/77; 524/275; 524/277; 524/278; 427/118; 427/409

[58] Field of Search ..... 428/380, 383, 375, 378, 428/379; 174/120 C, 120 SR, 110 SR, 110 FC; 524/275, 277, 278, 77

[56] References Cited

U.S. PATENT DOCUMENTS

| | | | |
|---|---|---|---|
| 3,247,141 | 4/1966 | Stryker et al. | 524/277 |
| 3,413,148 | 11/1968 | Sattler et al. | 428/457 |
| 3,775,175 | 11/1973 | Merian | 428/379 |
| 4,350,738 | 9/1982 | Saunders et al. | 428/383 |
| 4,378,407 | 3/1983 | Yamamoto et al. | 428/383 |
| 4,390,590 | 6/1983 | Saunders et al. | 428/383 |
| 4,400,430 | 8/1983 | Miyake et al. | 428/379 |
| 4,507,362 | 3/1985 | Chapin et al. | 428/383 |

FOREIGN PATENT DOCUMENTS

| | | | |
|---|---|---|---|
| 2031391 | 11/1970 | France . | |
| 129879 | 11/1978 | Japan | 524/277 |
| 640972 | 1/1984 | Switzerland . | |
| 2103868 | 2/1983 | United Kingdom . | |

*Primary Examiner*—George F. Lesmes
*Assistant Examiner*—S. A. Gibson
*Attorney, Agent, or Firm*—Frishauf, Holtz, Goodman & Woodward

[57] ABSTRACT

In an excellent windability magnet wire wherein an insulating layer of a synthetic resin film is formed on a conductor directly or with another insulation in between and a lubricant layer is formed on the insulating layer, the lubricant layer is made of an intimate mixture of natural wax as a major constituent and thermosetting and fluorocarbon resins compounded therewith.

10 Claims, 3 Drawing Figures

EXCELLENT WINDABILITY MAGNET WIRE

BACKGROUND OF THE INVENTION

The present invention relates to a magnet wire excellent in windability, lubricity, and abrasion resistance, which keeps its insulating film undamaged when wound into a coil, thereby contributing to improved productivity and yield of coil making.

Electrical equipment has been recently made compact and improved in performance and, in addition, at reduced cost. Along with these tendencies, the fabrication process has been systemized and simplified, and material cost has been reduced.

In the fabrication process of coils for motors, transformers, and the like, all of which play important roles in electrical equipment, an improvement in productivity by a high-speed coil winding process and an improvement in motor performance by an increase in occupation ratio of a magnet wire in a stator slot in a motor cause extensive studies in the advancement of compact arrangements. The systemization and simplification of the process for fabricating coils for motors, transformers, and the like as well as the compact configuration of electrical equipment impose severe conditions on magnet wire coatings used therein. For example, in the coil winding process, magnet wires tend to be brought into contact with pulleys, guides or the like in high-speed coil winding by an automatic winder. In addition, wire tension during the winding process is increased. The insulating coating tends to be damaged, thus causing defects such as a rare short.

Contact forces between magnet wires, between the magnet wire and a core, and between the magnet wire and an inserter blade are increased by an increase in occupation ratio in the stator slot of the motor and by introduction of an automatic inserter. The increases in contact forces mainly cause occurrence of defects. In order to prevent damage to the insulating film during the conventional coil winding process, an oil, paraffin wax or the like is coated on the insulating film to reduce a coefficient of friction thereof. However, such a conventional method cannot solve the above disadvantages.

U.S. Pat. No. 3,413,148 proposes a technique wherein a thin polyethylene layer is formed on a surface of an insulating film. This technique is effected to reduce the coefficient of friction to some extent, but is not expected to greatly improve the abrasion resistance of the insulating film. U.S. Pat. Nos. 3,775,175, 4,390,590 and 4,378,407, British Pat. No. 2,103,868, and Japanese Pat. No. 968283 propose techniques wherein a lubricant is added to or reacts with an insulating enamel to reduce a coefficient of friction so as to improve lubricity of the insulating film itself. These techniques have effects to some extent, but do not essentially prevent damage to the insulating film.

In order to overcome the disadvantages of the conventional techniques, the coefficient of friction must be greatly reduced, and abrasion resistance must be greatly improved.

SUMMARY OF THE INVENTION

The present invention has been made to overcome the conventional disadvantages described above, and has as its object to provide a magnet wire having a lubricant layer whose lubricity and abrasion resistance are greatly improved.

According to the present invention, as shown in FIG. 1, there is provided a magnet wire wherein insulating layer 2 made of a synthetic resin film is formed on conductor 1 directly or with another insulation in between, and lubricant layer 3 is formed on insulating layer 2, the improvement wherein the lubricant layer is made of an intimate mixture of natural wax as a major constituent and thermosetting and fluorocarbon resins compounded therewith.

DETAILED DESCRIPTION OF THE PREFERRED EMBODIMENTS

Figure 1:
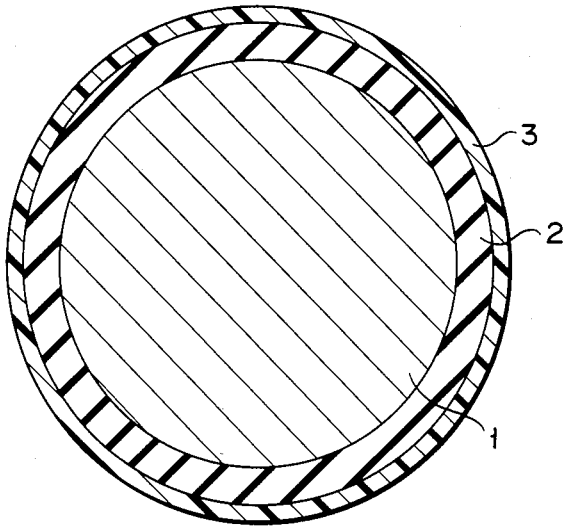
FIG. 1 is a cross-sectional view of an excellent windability magnet wire according to the present invention.

Natural wax used in the present invention can be preferably emulsified in water and preferably has high hardness. Examples of natural wax are carnauba wax, montan wax, bees wax, rice wax, and candelilla wax. Among these waxes, carnauba, montan and bees waxes have very high hardness and can be preferably used in the present invention.

A thermosetting resin used in the present invention is preferably soluble or emulsified in water. Examples of the thermosetting resin are an ammonium or alcohol solution of shellac, a water dispersion of acrylic resin, and an aqueous solution of water soluble phenolic resin. Among these resins, shellac and water soluble phenolic resin are the most preferable because the abrasion resistance of the resultant magnet wire is excellent and the preparation of its solution is easy.

A fluorocarbon resin used in the present invention preferably has a high content of fluorine. Examples of the fluorocarbon resin are polytetrafluoroethylene (PTFE), a fluorinated ethylene-propylene copolymer (FEP), and polytrifluorochloroethylene (PTFCE). Polytetrafluoroethylene and fluorinated ethylene-propylene copolymer are the most preferable. These fluorocarbon resins must be used in a form dispersed or emulsified in water and can be used as a commercially available dispersed or emulsified form of resin. Examples of PTFE water dispersion are T30J (trade name) available from DuPont-Mitsui Fluorochemical Co., Ltd., and AS COAT Nos. 5, 6, and 20 (trade names) available from SATO, K.K. An example of FEP water dispersion is T120 (trade name) available from DuPont-Mitsui Fluorochemical Co., Ltd.

A weight ratio of natural wax to thermosetting resin as the constituting components in the lubricant layer is preferably 80/20 to 60/40 and most preferably 75/25 to 65/35. If the content of natural wax exceeds 80 parts by weight, the abrasion resistance of the resultant magnet wire is slightly degraded. If the content of natural wax is less than 60 parts by weight, lubricity of the resultant wire is degraded.

The content of the fluorocarbon resin for 100 parts by weight of natural wax and thermosetting resin is preferably 1 to 30 parts by weight and, most preferably 7 to 20 parts by weight. If the content of the fluorocarbon resin is less than 1 part by weight, the abrasion resistance and lubricity of the magnet wire are degraded. If the content of the fluorocarbon resin exceeds 30 parts by weight, an adhesion property between the insulating layer and the lubricant layer is degraded.

A preparation method of a lubricant paint used to form the lubricant layer having the above composition is exemplified as follows.

A predetermined amount of natural wax is mixed with a small amount of an emulsifier (surfactant), required for emulsifying the natural wax, such as polyoxyethylene alkylether or sorbitane monoalkylester, and the resultant mixture is heated and melted. Water is added to the melt, and the resultant mixture is heated and then cooled to prepare an emulsion. A thermosetting resin solution or dispersion is added to the emulsion, and a water dispersion of a fluorocarbon resin is added to the resultant mixture. The mixture is stirred at a high speed by a homogenizer to obtain a uniform lubricant paint. Such a lubricant paint may be obtained by adding a water dispersion of a fluorocarbon resin in a commercially available mixing dispersion of natural wax and thermosetting resin.

The concentration of the resultant lubricant layer paint is controlled to be 5 to 15%. The paint is continuously applied to the insulating layer by die or felt coating and is hardened when the paint passes through a furnace at a temperature of 200° to 600° C. The thickness of the lubricant layer is preferably 0.2 to 2.0 μm. If the thickness of the lubricant layer is less than 0.2 μm, lubricity is excellent but the improvement of abrasion resistance is degraded. However, if the thickness exceeds 2.0 μm, the property of adhesion between the insulating layer and the lubricant layer, and therefore the abrasion resistance are degraded. The thickness of the lubricant layer is most preferably 0.5 to 1.0 μm.

Examples of the resin for forming an insulating layer on the magnet wire in the present invention are polyvinylformal, polyester, polyesterimide, polyesteramideimide, polyamideimide, polyimide, polyhydantoin, polyurethane, polyamide, epoxy, acrylic and polyetherimide. Such a resin is applied by enamel coating-and-baking, extrusion coating, powder coating, or electrodeposition coating. In this case, the insulating layer consists of a single layer of a resin or a multilayer of at least two resins.

EXAMPLES 1-7 and COMPARATIVE EXAMPLES 1-14

100 parts by weight of carnauba wax No. 1, 3 parts by weight of sorbitane mono-oleate, 2 parts by weight of polyoxyethylene stearylether were melted at 100° C., and the resultant melt was poured in boiling water stirred at high speed. When the solution was stirred uniformly, the stirred solution was cooled to obtain a carnauba wax emulsion. An ethyl alcohol solution of shellac and a water dispersion of polytetrafluoroethylene (PTFE) T30J (trade name) available from DuPont-Mitsui Fluorochemical Co., Ltd. were added to the carnauba wax emulsion, and the resultant mixture was uniformly homogenized by a homogenizer to prepare a lubricant layer paint (A) having a mixing ratio of carnauba wax/shellac/PTFE being 70/30/10 and having a concentration of 7.5%.

40-μm thick insulating layers 2 were respectively formed on copper wires 1 each having a diameter of 1.0 mm by using various coating materials and methods shown in Table 1. The lubricant layer paint (A) was applied to the respective insulating layers and was baked thereon in a baking furnace having a furnace temperature of 400° C. and a furnace length of 4 m at a rate of 12 m/min, thereby forming 0.7-μm thick lubricant layers 3 (FIG. 1).

Figure 2:
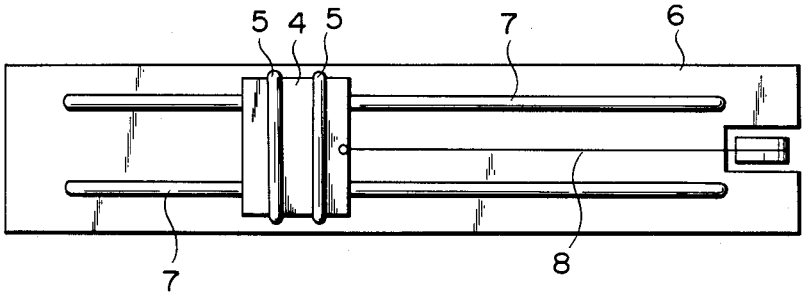
FIG. 2 is a plan view of equipment for coefficient of static friction so as to measure coefficients of static friction of excellent windability magnet wires of the present invention.
Figure 3:
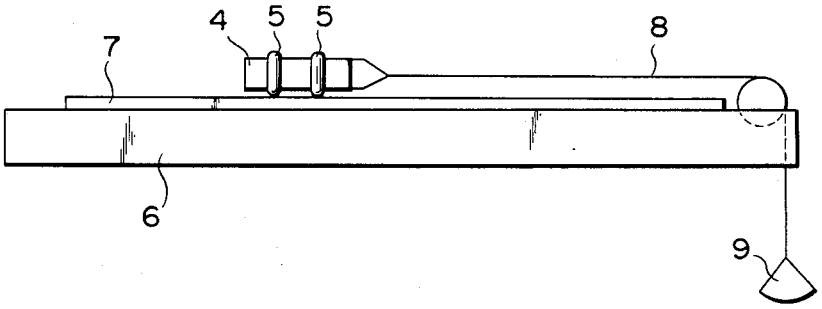
FIG. 3 is a side view of the equipment shown in FIG. 2.

In order to check the properties of the resultant magnet wires, the abrasion resistances and dielectric strengths were measured according to NEMA MW1000 and JIS C3003 and coefficients of friction were measured according to DIN 46453. In addition, by using equipment for coefficient of static friction shown in FIGS. 2 and 3, coefficients of static friction of the wires were measured. The measurement results are summarized in Table 2.

Various types of magnet wires (Comparative Examples 1, 3, 5, 7, 9, 11, and 13) without the lubricant layers shown in Table 1 and wires (Comparative Examples 2, 4, 6, 8, 10, 12, and 14) obtained by a conventional method for applying paraffin wax (melting point of 140° F.) shown in Table 1 to the corresponding insulating layers were prepared for comparison. The properties of the resultant wires were measured in the same manner as in the examples. Results are summarized in Table 2. The coefficients of static friction of the wires were measured as coefficients of interline friction by using equipment shown in FIGS. 2 and 3 in the following manner. Two parallel sample wires 5 were attached to metal block 4 having a predetermined load and were placed on two parallel sample wires 7 placed on glass plate 6. Wires 5 were perpendicular to wires 7. The weight of counterweight 9 connected to the distal end of lead wire 8, the proximal end of which was connected to block 4, was increased until block 4 started to move. The coefficients of static friction were calculated by the following equation:

(Coefficient of Static Friction) $\mu$=(Weight of Counterweight when Block Started to Move) (g)/(Weight of Block) (g).

TABLE 1

| | Enamel Coating and Baking | | | | | | |
|---|---|---|---|---|---|---|---|
| | Resin | | | | | | |
| Insulating Layer Forming Method | Polyester | Polyester-imide | Polyamide-imide | Polyimide | Polyamideimide-overcoated Polyesterimide | Powder Coating Epoxy | Extrusion Coating Polyether-imide |
| With Lubricant Layer | Example 1 | Example 2 | Example 3 | Example 4 | Example 5 | Example 6 | Example 7 |
| Without Lubricant Layer | Comparative Example 1 | Comparative Example 3 | Comparative Example 5 | Comparative Example 7 | Comparative Example 9 | Comparative Example 11 | Comparative Example 13 |
| Paraffin Wax | Comparative | Comparative | Comparative | Comparative | Comparative | Comparative | Comparative |

TABLE 1-continued

| Insulating Layer Forming Method | Enamel Coating and Baking Resin: Polyester | Polyester-imide | Polyamide-imide | Polyimide | Polyamideimide-overcoated Polyesterimide | Powder Coating Epoxy | Extrusion Coating Polyether-imide |
|---|---|---|---|---|---|---|---|
| (m.p. 140° F.) | Example 2 | Example 4 | Example 6 | Example 8 | Example 10 | Example 12 | Example 14 |

*Polyester: Isonel 200 (trade name) available from Nisshoku Schenectady Chemicals Inc.
*Polyesterimide: Isomid (trade name) available from Nisshoku Schenectady Chemicals Inc.
*Polyamideimide: HI405 (trade name) available from Hitachi Chemical Co., Ltd.
*Polyimide: Pyre-ML (trade name) available from E. I. DuPont de Nemours Co., USA
*Epoxy: XR5256 (trade name) available from 3M Co., USA
*Polyetherimide: ULTEM (trade name) available from General Electric Co., USA

TABLE 2

| Example and Comparative Example | Abrasion Resistance: Unidirectional (g) (NEMA NW1000) | Abrasion Resistance: Repeated (Strokes) (JIS C3003) | Coefficient of friction: According to FIGS. 2 and 3 | Coefficient of friction: DIN 46453 | Dielectric Strength (KV) NEMA MW1000 |
|---|---|---|---|---|---|
| Example 1 | 1610 | 540 | 0.027 | 0.17 | 13.8 |
| Comparative Example 1 | 1405 | 32 | 0.145 | 0.28 | 13.9 |
| Comparative Example 2 | 1450 | 65 | 0.086 | 0.26 | 13.5 |
| Example 2 | 1680 | 609 | 0.028 | 0.16 | 15.0 |
| Comparative Example 3 | 1420 | 54 | 0.137 | 0.25 | 14.8 |
| Comparative Example 4 | 1420 | 76 | 0.080 | 0.23 | 14.8 |
| Example 3 | 2030 | 790 | 0.026 | 0.16 | 15.5 |
| Comparative Example 5 | 1530 | 220 | 0.150 | 0.28 | 15.0 |
| Comparative Example 6 | 1590 | 240 | 0.075 | 0.28 | 15.5 |
| Example 4 | 2020 | 860 | 0.030 | 0.17 | 14.7 |
| Comparative Example 7 | 1450 | 65 | 0.158 | 0.29 | 14.6 |
| Comparative Example 8 | 1510 | 80 | 0.081 | 0.25 | 15.0 |
| Example 5 | 1990 | 750 | 0.026 | 0.18 | 15.0 |
| Comparative Example 9 | 1510 | 180 | 0.139 | 0.27 | 15.5 |
| Comparative Example 10 | 1520 | 183 | 0.075 | 0.25 | 14.7 |
| Example 6 | 1730 | 437 | 0.031 | 0.19 | 12.1 |
| Comparative Example 11 | 1400 | 28 | 0.178 | 0.28 | 10.9 |
| Comparative Example 12 | 1430 | 30 | 0.101 | 0.24 | 11.7 |
| Example 7 | 1705 | 363 | 0.033 | 0.19 | 13.7 |

TABLE 2-continued

| Example and Comparative Example | Abrasion Resistance: Unidirectional (g) (NEMA NW1000) | Abrasion Resistance: Repeated (Strokes) (JIS C3003) | Coefficient of friction: According to FIGS. 2 and 3 | Coefficient of friction: DIN 46453 | Dielectric Strength (KV) NEMA MW1000 |
|---|---|---|---|---|---|
| Comparative Example 13 | 1350 | 37 | 0.135 | 0.29 | 13.5 |
| Comparative Example 14 | 1380 | 40 | 0.090 | 0.28 | 13.8 |

As is apparent from Table 2, the abrasion resistances and lubricity of the magnet wires according to the present invention are far better than the conventional magnet wires without lubricant layers and with paraffin wax coatings, and the electrical characteristics of the magnet wires of the present invention are equivalent or better than those of the conventional magnet wires.

EXAMPLES 8–11

A polyamideimide paint used in the previous examples was applied and baked to form 40-μm thick insulating layers on copper wires. Following the same procedures as in the previous examples, the lubricant layer paint (A) was applied to the insulating layers to form 0.1-, 0.3-, 1.8-, and 2.5-μm thick lubricant layers thereon.

Following the same procedures as in Examples 1 to 7, the properties of the resultant magnet wires were measured, and the test results are shown in Table 3. The properties of the wire in Example 3 (thickness of the lubricant layer is 0.7 μm) are also listed in Table 3.

TABLE 3

| Example | Lubricant Layer Thickness (μm) | Abrasion Resistance: Unidirectional (g) (NEMA NW1000) | Abrasion Resistance: Repeated (Strokes) (JIS C3003) | Coefficient of friction: According to FIGS. 2 and 3 | Coefficient of friction: DIN 46453 | Dielectric Strength (KV) NEMA MW1000 |
|---|---|---|---|---|---|---|
| 8 | 0.1 | 1730 | 420 | 0.034 | 0.23 | 14.9 |
| 9 | 0.3 | 1950 | 730 | 0.027 | 0.15 | 14.9 |
| 10 | 1.8 | 1960 | 690 | 0.026 | 0.17 | 15.8 |
| 11 | 2.5 | 1760 | 480 | 0.029 | 0.20 | 14.7 |
| 3 | 0.7 | 2030 | 790 | 0.026 | 0.16 | 15.5 |

As is apparent from Table 3, when the thickness of the lubricant layer is less than 0.2 μm or exceeds 2.0 μm, the abrasion resistance is degraded.

EXAMPLES 12–23

Lubricant layer paints (B) to (M) were prepared. The same emulsifier for natural wax and the same emulsifying method as in the preparation of the paint (A) were used. Compositions of paints (B) to (M) are summarized in Table 4. Shellac was added in the form of an ethyl alcohol solution, and water-soluble phenolic resin was added as a deionized aqueous solution. The concentration of each paint was 7.5%. The resultant paints (B) to (M) were applied to and baked on polyamideimide-coated magnet wires each having a diameter of 1.0 μm to form 0.7-μm thick lubricant layers, following the same procedures as in Example 3. The properties of the resultant magnet wires were measured in the same manner as in Example 1, and results are summarized in Table 5.

TABLE 4

| | | (Unit: Solid weight ratio) | | | | | | | | | | | |
|---|---|---|---|---|---|---|---|---|---|---|---|---|---|
| | | B | C | D | E | F | G | H | I | J | K | L**** | M**** |
| Natural Wax | Carnauba Wax | 85 | 78 | 55 | | 70 | 70 | 70 | 70 | 70 | 70 | 100 | 100 |
| | Montan Wax | | | | 70 | | | | | | | | |
| Thermo-setting Resin | Shellac | 15 | 22 | 45 | 30 | | 30 | 30 | 30 | 30 | 30 | | |
| | Water-Soluble Phenol Resin* | | | | | 30 | | | | | | | |
| Fluoro-carbon Resin | PTFE** | 10 | 10 | 10 | 10 | 10 | | 2 | 0.5 | 27 | 40 | 10 | |
| | FEP*** | | | | | | 10 | | | | | | 10 |

*J-303 (trade name) available from DAINIPPON INK & CHEMICALS INC.
**T30J (trade name) available from DuPont-Mitsui Fluorochemical Co., Ltd.
***T120 (trade name) available from DuPont-Mitsui Fluorochemical Co., Ltd.
****L,M TEC9601 (trade name) available from Toshiba Chemical Products Co., Ltd. and used as an intimate mixture of carnauba wax and shellac

TABLE 5

| Example | Lubricant Layer Paint | Abrasion Resistance: Unidirectional (g) (NEMA NW1000) | Abrasion Resistance: Repeated (strokes) (JIS C3003) | Coefficient of friction: According to FIGS. 2 and 3 | Coefficient of friction: DIN 46453 | Dielectric Strength (KV) NEMA MW1000 |
|---|---|---|---|---|---|---|
| 12 | B | 1710 | 280 | 0.029 | 0.18 | 14.9 |
| 13 | C | 2010 | 750 | 0.026 | 0.17 | 15.1 |
| 14 | D | 1870 | 450 | 0.049 | 0.23 | 15.1 |
| 15 | E | 2000 | 760 | 0.027 | 0.17 | 14.8 |
| 16 | F | 2150 | 690 | 0.025 | 0.18 | 14.5 |
| 17 | G | 1930 | 630 | 0.025 | 0.16 | 15.3 |
| 18 | H | 1910 | 550 | 0.031 | 0.20 | 15.0 |
| 19 | I | 1680 | 350 | 0.041 | 0.28 | 14.6 |
| 20 | J | 2150 | 860 | 0.024 | 0.16 | 14.5 |
| 21 | K | 1630 | 290 | 0.029 | 0.18 | 14.1 |
| 22 | L | 2060 | 780 | 0.026 | 0.16 | 15.5 |
| 23 | M | 1950 | 690 | 0.026 | 0.16 | 15.1 |

As shown in Examples 12 to 23, when the content of natural wax exceeded 80 parts by weight with respect to 100 parts by weight of the mixture of natural wax and thermosetting resin, the improvement of abrasion resistance was degraded. However, if the content of natural wax was less than 60 parts by weight, the improvement of lubricity was degraded.

If the content of fluorocarbon resin was less than 1 part by weight with respect to 100 parts by weight of the mixture of natural wax and thermosetting resin, the abrasion resistance and lubricity were degraded. If the content of fluorocarbon resin exceeded 30 parts by weight, the abrasion resistance was degraded.

EXAMPLE 24

One hundred parts by weight of fine alumina powder having a particle size of 1 to 6 μm and 90 parts by weight of a silicone resin solution (TRS116: trade name available from Toshiba Silicone Co., Ltd.,) were put into a ball mill and were mixed for about 4 hours, thus obtaining a silicone resin paint compounded with an inorganic material. The resultant paint was applied to a nickel-plated copper wire having a diameter of 1.0 mm according to die coating and was baked in a furnace having a length of 4 m and a temperature of 400° C. at a rate of 8 m/min, thereby obtaining a 30-μm thick inorganic insulating layer. A polyamideimide paint as in Example 3 was applied and baked on the inorganic insulating layer to form a 10-μm polyamideimide resin layer thereon.

Following the same procedures as in Example 1, the lubricant layer paint (A) was applied to and baked on the resultant magnet wire. The properties of the resultant magnet wires were measured in the same manner as in Examples 1 to 23, and results are summarized in Table 6. The properties of the conventional wires without the lubricant layers are also listed in Table 6.

TABLE 6

| Lubricant Layer | Abrasion Resistance: Unidirectional (g) (NEMA NW1000) | Abrasion Resistance: Repeated (strokes) (JIS C3003) | Coefficient of friction: According to FIGS. 2 and 3 | Coefficient of friction: DIN 46453 | Dielectric Strength (KV) NEMA MW1000 |
|---|---|---|---|---|---|
| No | 1670 | 153 | 0.14 | 0.28 | 7.8 |
| Yes | 2010 | 530 | 0.026 | 0.16 | 8.0 |

As is apparent from Table 6, the magnet wires of a composite inorganic-organic material according to the present invention have excellent properties such as high abrasion resistance and good lubricity.

What is claimed is:

1. An excellent windability magnet wire wherein an insulating layer of a synthetic resin film is formed on a conductor directly or with another insulation in between and a lubricant layer is formed on the insulating layer, the improvement wherein the lubricant layer is made of an intimate mixture of natural wax as a major constituent and thermosetting and fluorocarbon resins compounded therewith.

2. A wire according to claim 1, wherein the lubricant layer is made of an intimate mixture prepared by adding 1 to 30 parts by weight of the fluorocarbon resin into 100 parts by weight of natural wax and thermosetting resin.

3. A wire according to claim 1, wherein a mixing ratio of natural wax to thermosetting resin in the lubricant layer is 80/20 to 60/40.

4. A wire according to claim 1, wherein the fluorocarbon resin is at least one resin selected from the group consisting of polytetrafluoroethylene and a fluorinated ethylenepropylene copolymer.

5. A wire according to claim 1, wherein the natural wax is at least one wax selected from the group consisting of carnauba wax and montan wax.

6. A wire according to claim 1, wherein the thermosetting resin is at least one resin selected from the group consisting of shellac and water-soluble phenol resin.

7. A wire according to claim 1, wherein the lubricant layer has a thickness falling within the range of 0.2 to 2 μm.

8. A wire according to claim 1, wherein the insulating layer of the synthetic resin film comprises a resin selected from the group consisting of polyvinylformal, polyester, polyesterimide, polyesteramideimide, polyamideimide, polyimide, polyhydantoin, polyurethane, polyamide, epoxy, acrylic and polyetherimide.

9. A wire according to claim 1, wherein the insulating layer of the synthetic resin film comprises a multilayer made of at least two resins selected from the group consisting of polyvinylformal, polyester, polyesterimide, polyesteramideimide, polyamideimide, polyimide, polyhydantoin, polyurethane, polyamide, epoxy, acrylic and polyetherimide.

10. A wire according to claim 1, wherein the synthetic resin insulating layer is formed by one process selected from the group consisting of enamel coating-and-baking, power coating, extrusion coating, or electrodepositon coating of an insulating paint.

* * * * *